US008720458B2

(12) United States Patent
Dickerson, II

(10) Patent No.: US 8,720,458 B2
(45) Date of Patent: May 13, 2014

(54) TUBULAR CRUTCH WITH A CANTILEVER HANDLE

(75) Inventor: Philip William Dickerson, II, Reno, NV (US)

(73) Assignee: Careborne, LLC, Reno, NV (US)

( * ) Notice: Subject to any disclaimer, the term of this patent is extended or adjusted under 35 U.S.C. 154(b) by 0 days.

(21) Appl. No.: 13/401,163

(22) Filed: Feb. 21, 2012

(65) Prior Publication Data

US 2012/0318313 A1 Dec. 20, 2012

Related U.S. Application Data

(60) Provisional application No. 61/497,841, filed on Jun. 16, 2011.

(51) Int. Cl.

| | |
|---|---|
| ***A61H 3/02*** | (2006.01) |
| ***A45B 9/02*** | (2006.01) |
| ***B25G 1/00*** | (2006.01) |
| ***B25G 1/10*** | (2006.01) |

(52) U.S. Cl.

CPC .. *A61H 3/02* (2013.01); *A45B 9/02* (2013.01); *B25G 1/102* (2013.01)

USPC ..... 135/71; 135/68; 135/72; 16/422

(58) Field of Classification Search

CPC ..... A61H 3/02; A45B 9/02; B25G 1/102; B25G 3/32; B25G 3/34

USPC ..... 135/65, 68–69, 71–73, 75–76, 82; D3/5–17; 16/110.1, 407, 421–422, 430

See application file for complete search history.

(56) References Cited

U.S. PATENT DOCUMENTS

| | | | |
|---|---|---|---|
| 437,024 | A | 9/1890 | Doe |
| 1,209,997 | A | 12/1916 | Pettingill |
| 1,262,905 | A | 4/1918 | Anderson |
| 1,311,664 | A | 7/1919 | Pearl |
| 2,197,279 | A | 4/1940 | Thorssen |
| 2,358,853 | A | 9/1944 | Dunnicliff |
| 2,388,778 | A | 11/1945 | Wheeler |

(Continued)

FOREIGN PATENT DOCUMENTS

JP 2003062021 A * 3/2003 ..... A61H 3/00

OTHER PUBLICATIONS

Please see unpublished patent application 09/657,864 (Sep. 7, 2000).

(Continued)

*Primary Examiner* — Winnie Yip

(74) *Attorney, Agent, or Firm* — Michael A. Kerr; Kerr IP Group, LLC

(57) ABSTRACT

A tubular crutch including a tubular crutch body, a cantilever handle and a ground engaging extension is described. The tubular crutch body includes a tubular posterior stabilizing element, a first concave curve adjacent to the posterior stabilizing element, a second convex curve proximate to the first concave curve, a third concave curve proximate to the second convex curve and a tubular elongated portion adjacent to the third concave curve. The cantilever handle includes a curved base plate, a bolt, a tubular member, a nut and a contoured component. The tubular crutch also includes a ground engaging extension with a spring loaded button that is configured to be received at the bottom of the tubular elongated member.

19 Claims, 6 Drawing Sheets

(56) References Cited

U.S. PATENT DOCUMENTS

| | | | | | |
|---|---|---|---|---|---|
| 2,408,604 | A | * | 10/1946 | Brickson | 135/69 |
| 2,442,896 | A | | 6/1948 | Joseph | |
| 2,576,643 | A | * | 11/1951 | Roerig | 411/435 |
| 2,707,478 | A | | 1/1952 | Davies | |
| 2,696,826 | A | | 6/1952 | Davies | |
| 2,741,255 | A | | 4/1956 | Neptune | |
| 2,788,793 | A | | 4/1957 | Abbott | |
| 3,133,551 | A | | 5/1964 | Murcott | |
| 3,157,187 | A | | 11/1964 | Murcott | |
| 3,191,826 | A | * | 6/1965 | Adams | 224/185 |
| 3,213,869 | A | * | 10/1965 | Frank | 135/71 |
| 3,213,870 | A | | 10/1965 | Kiehn | |
| 3,269,399 | A | | 8/1966 | Smith | |
| 3,335,735 | A | * | 8/1967 | Colegrove et al. | 135/69 |
| 3,730,198 | A | | 5/1973 | Johnston et al. | |
| 3,947,140 | A | | 3/1976 | Thomas | |
| 4,196,742 | A | | 4/1980 | Owen, Jr. | |
| 4,637,414 | A | | 1/1987 | Urban | |
| 4,787,405 | A | | 11/1988 | Karwoski | |
| 5,139,040 | A | * | 8/1992 | Kelly | 135/69 |
| 5,201,334 | A | * | 4/1993 | Tseng | 135/68 |
| 5,351,702 | A | | 10/1994 | Denjean | |
| 5,482,070 | A | | 1/1996 | Kelly | |
| 5,495,867 | A | * | 3/1996 | Block | 135/65 |
| 5,606,985 | A | | 3/1997 | Battiston et al. | |
| 5,673,719 | A | | 10/1997 | Shofner | |
| 5,725,005 | A | * | 3/1998 | Yamasaki et al. | 135/73 |
| 5,845,664 | A | | 12/1998 | Ryder et al. | |
| 5,848,603 | A | | 12/1998 | Urban | |
| 5,924,434 | A | | 7/1999 | Cato, III | |
| 6,085,766 | A | | 7/2000 | Geary | |
| 6,378,541 | B1 | * | 4/2002 | Matthews | 135/68 |
| 7,104,271 | B2 | | 9/2006 | Larson et al. | |
| D552,245 | S | * | 10/2007 | Davis | D24/188 |
| 7,434,592 | B2 | | 10/2008 | Larson et al. | |
| D600,002 | S | * | 9/2009 | Fulkerson | D3/8 |
| 2009/0266392 | A1 | | 10/2009 | Campbell et al. | |

OTHER PUBLICATIONS

Please see unpublished patent application 8/258,522 (Jun. 10, 1994).

* cited by examiner

TUBULAR CRUTCH WITH A CANTILEVER HANDLE

CROSS REFERENCE

This patent application claims the benefit of provisional patent application 61/497,841 filed on Jun. 16, 2011 and entitled TUBULAR CRUTCH WITH A CANTILVER HANDLE.

FIELD

This description relates to a tubular crutch with a cantilever handle. More particularly, the description relates to a tubular crutch with a tubular crutch body that includes a posterior stabilizing element and the cantilever handle includes an angled tubular member.

BACKGROUND

Crutches have been used by individuals with lower extremity disablements for over 5,000 years. Unfortunately, the crude form of axillary or underarm crutches depicted in ancient illustrations has not changed appreciably.

In spite of the lack of improvement in the basic design of axillary or underarm crutches they are still widely used as they are inexpensive, functional and light in weight. These are very important elements in the rehabilitation of short-term users and for handicapped individuals who use crutches as a primary means of ambulating. However, the standard axillary crutches are difficult to use, inherently unstable, and improper use will cause underarm irritation and soreness and prolonged use can cause permanent damage to the user. A very large number of people require the use of crutches each year, and the need for an improved design that is easier and especially safer to use continues.

The difficult activity of crutch ambulation has long been recognized and there have been numerous attempts within the prior art to overcome the disadvantages inherent with typical crutches.

Underarm or axillary crutches require the user to support the majority of his body weight by the arms and hands at the hand grip of the crutch. When the user takes a forward step he applies a forward thrust to the crutches at the handgrip. This forward thrust in turn must be transferred through the crutches to the user's body to complete the forward moving step. To accomplish this transfer of thrust the user must first make certain the crutches don't slip out from under his arm and then transfer the thrust to his body by developing a resisting frictional force between the axillary pad and the body. Many individuals lacking adequate strength or skill are unable to use the crutches in this manner and find it necessary to clamp the axillary bar under the arms to transfer the forward thrust. This procedure even though widely used is not recommended and results in discomfort and soreness under the armpits. In spite of the discomfort, crutch users continue to clamp the axillary bar under their arms because it is imperative that the crutches not slip or the user would fall and further injury could result.

SUMMARY

A tubular crutch including a tubular crutch body, a cantilever handle and a ground engaging extension is described. The tubular crutch body includes a tubular posterior stabilizing element, a first concave curve adjacent to the posterior stabilizing element, a second convex curve proximate to the first concave curve, a third concave curve proximate to the second convex curve and a tubular elongated portion adjacent to the third concave curve. The first concave curve, the second convex curve, the third concave curve and tubular crutch body are disposed along a first plane. A tubular elongated portion is adjacent to the third concave curve having a first grouping of orifices along the first plane, and a second plurality of orifices at the bottom of the tubular elongated portion.

The cantilever handle includes a curved base plate, a bolt, a tubular member, a nut and a contoured component. The curved base plate is configured to interface with the tubular elongated portion and includes a base plate orifice. The bolt has a threaded end and a head end, in which the head end is fixedly coupled to a convex side of the curved base plate and the threaded end of the bolt is at a 90° angle from the base plate. The tubular member has one end fixedly coupled to the convex side of the curved base plate. The bolt passes through one pair of the first orifices. The nut receives the threaded end of the bolt. The contoured component ergonomically interfaces with a palm of a hand.

The tubular crutch also includes a ground engaging extension with a spring loaded button that is configured to be received by at least one of the second plurality of orifices at the bottom of the tubular elongated member.

In a first embodiment, a contoured washer is disposed on the opposite side of the tubular elongated portion and the threaded bolt is configured to pass through the washer. Also, in the first embodiment, the nut includes a wing nut and a biasing element that is configured to lock the wing nut in place. Additionally, the bolt in the first embodiment is welded to the base plate and the tubular member is welded to the base plate. Furthermore, the handle in the first embodiment includes a steel material and the tubular crutch body includes an aluminum material. Further still, the biasing element for the wing nut in the first embodiment includes a nylon ring disposed on a winged end of the wing nut and an outer surface of the nylon ring interfaces with the inner threaded surface of the wing nut.

In a broad embodiment, the first concave curve includes a first radius and a first angle of approximately 75°-85°, the second convex curve has the same first radius and a second angle of approximately 152°-162°, the third concave curve includes the same first radius and a third angle of approximately 56.5°-66.5°, and a tubular elongated portion center line that is 10°-20° from a tubular posterior stabilizing element center line.

In a narrow embodiment, the tubular crutch body includes the first concave curve having the first angle of approximately 80°, the second convex curve having the second angle of approximately 157°, the third concave curve having the third angle of approximately 61.5°, and the tubular elongated portion center line is 15.5° from the tubular posterior stabilizing element center line.

In the broad embodiment, the tubular member is configured to extend into the first plane at approximately 75°-80° degrees from the curved base plate. In a narrow embodiment, the tubular member extends into the first plane at approximately 78° degrees from the curved base plate.

A kit of parts for assembly to a crutch is also described. The kit of parts includes a tubular crutch body, a ground engaging extension, a cantilever handle with a curved base plate and bolt, a wing nut, and a contoured component as described above. Additionally, the first embodiment includes a contoured washer configured to be disposed on the opposite side of the tubular elongated portion as described above.

DRAWINGS

The present invention will be more fully understood by reference to the following drawings which are for illustrative, not limiting, purposes.

DESCRIPTION

Persons of ordinary skill in the art will realize that the following description is illustrative and not in any way limiting. Other embodiments of the claimed subject matter will readily suggest themselves to such skilled persons having the benefit of this disclosure. It shall be appreciated by those of ordinary skill in the art that the systems and apparatus described hereinafter may vary as to configuration and as to details. Additionally, the methods may vary as to details, order of the actions, or other variations without departing from the illustrative methods disclosed herein.

A tubular crutch with an ergonomically designed cantilever handle is described herein. The tubular crutch with the cantilever handle transfers the forward thrust from the hands directly to the user's back without the necessity of clamping the axillary element under the arm. As described herein, incorporating an axillary element having a posterior extension makes the crutches easier to use, increases stability, is much safer for the user, and eliminates the underarm soreness and irritation caused by clamping the axillary element under the arms. The posterior extension causes the crutch to be used in a more vertical, upright position, allowing a greater percentage of the crutch tip to make contact with the surface.

Figure 1:
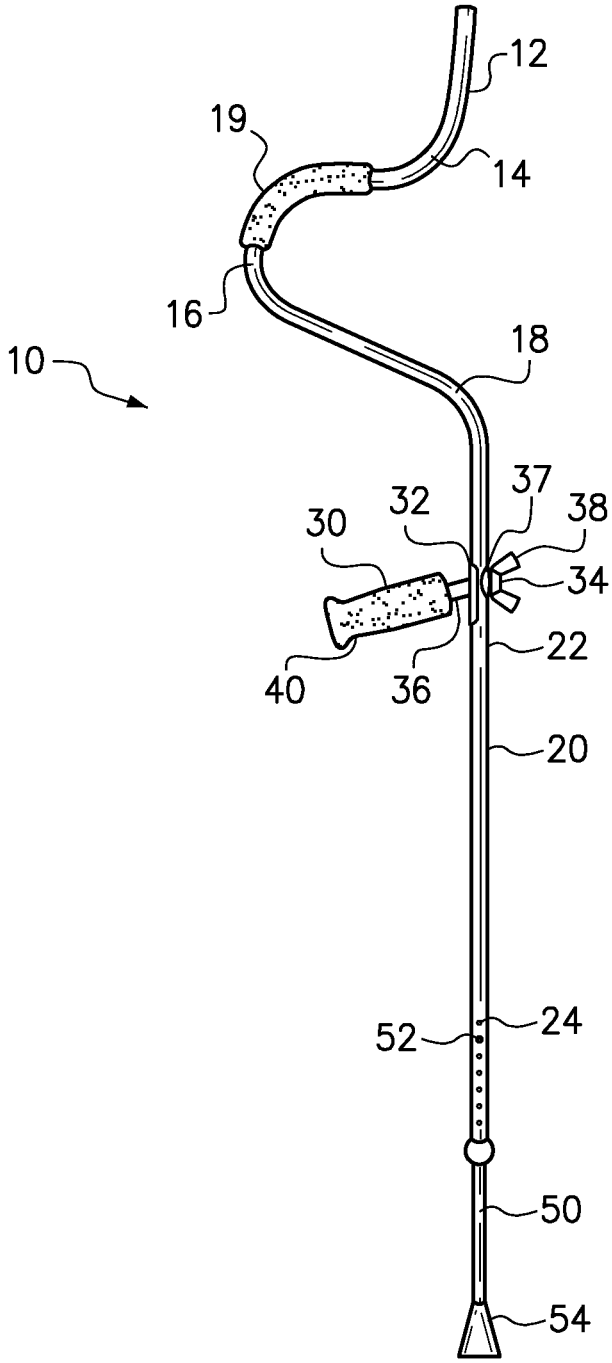
FIG. 1 shows an illustrative tubular crutch with a cantilever handle.

Referring to FIG. 1, there is shown an illustrative tubular crutch with a cantilever handle. The tubular crutch body 10 includes a tubular posterior stabilizing element 12, a first concave curve 14 adjacent to the posterior stabilizing element 12, a second convex curve 16 proximate to the first concave curve 14, a third concave curve 18 proximate the second convex curve 16 and a tubular elongated portion 20 adjacent to the third concave curve 18. The first concave curve 14, the second convex curve 16, the third concave curve 18 and tubular crutch body 10 are disposed along a first plane that is parallel the median plane of the user.

A sleeve 19 is located between the first concave curve 14 and the second convex curve 16. By way of example and not of limitation, the illustrative sleeve 19 is composed of molded or extruded elastic materials having foam-like and/or rubber-like properties with a high coefficient of friction. The sleeve 19 is configured to fit adjacent to the user's chest. As described in further detail below, the back of the user's shoulder interfaces with the tubular posterior stabilizing element 12 which has a low coefficient of friction so the tubular posterior stabilizing element 12 is relatively slippery when compared to the sleeve 19.

A tubular elongated portion 20 is adjacent to the third concave curve 18 and includes a first grouping of orifices 22 or bored holes along the first plane. Additionally, the tubular elongated portion 20 includes a second set of orifices 24 or bored holes at the bottom of the tubular elongated portion. The second set of bored holes 24 are at a 90° degree angle from the first grouping of orifices 22.

The cantilever handle 30 includes a curved base plate 32, a bolt 34, a tubular member 36, a nut 38 and a contoured component 40. The curved base plate 32 is configured to interface with the tubular elongated portion 20 and includes a base plate orifice 33. The bolt 34 has a threaded end and a head end, in which the head end is fixedly coupled to a convex side of the curved base plate 32 and the threaded end of the bolt is at a 90° angle from the curved base plate 32. In the illustrative embodiment, the bolt 34 is welded to the curved base plate 32 and the tubular member 36 is welded to the base plate.

Figure 6:
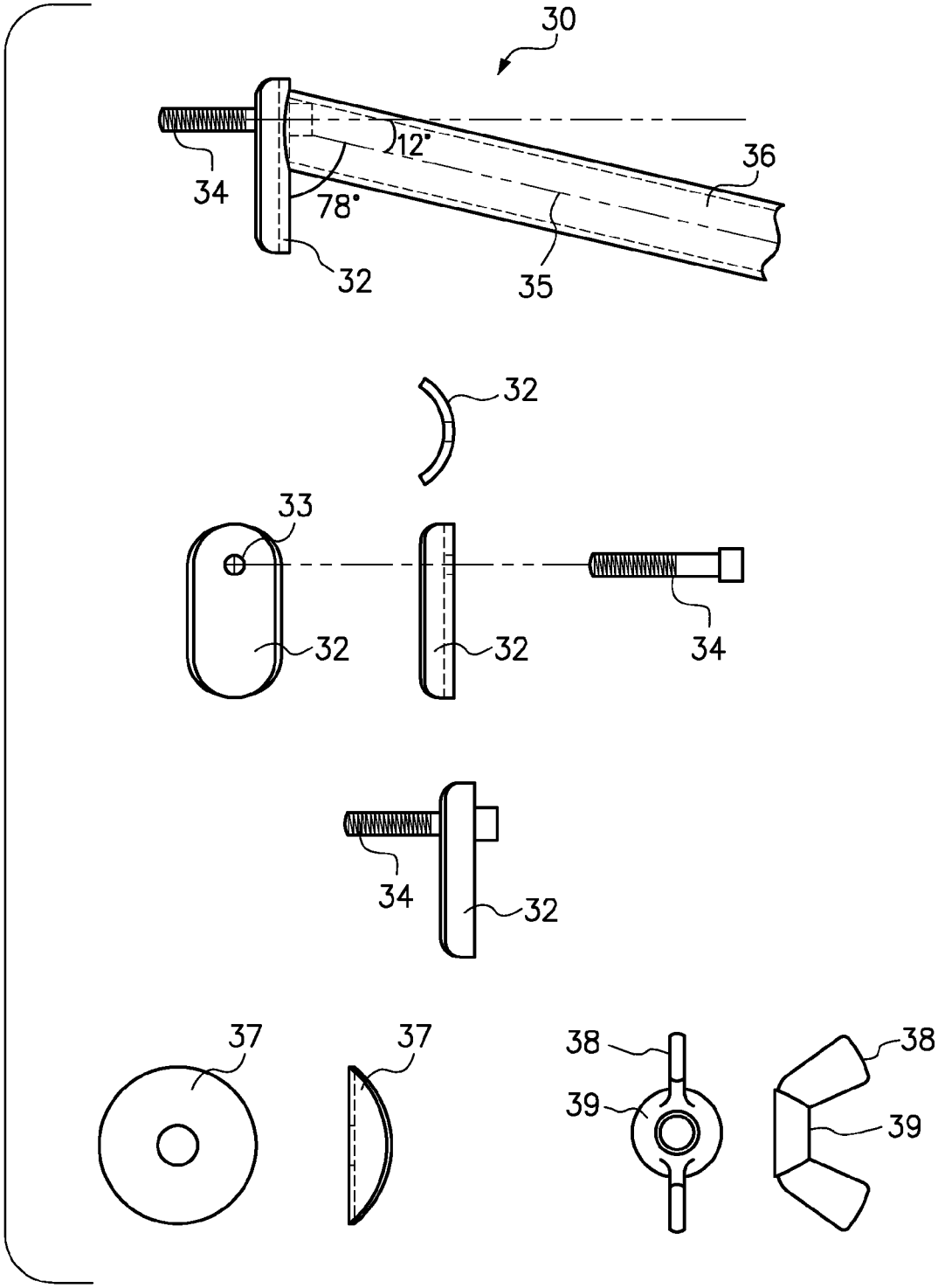
FIG. 6 shows some of the component pieces of the cantilever handle.

The bolt 34 in relation to the curved base plate 32 is described in further detail in FIG. 6 below. The tubular member 36 has one end fixedly coupled to the convex side of the curved base plate 32 as shown in FIG. 6. The bolt 34 passes through one pair of the first orifices 22. In the illustrative embodiment, a contoured washer 37 is disposed on the opposite side of the tubular elongated portion 20 and the threaded bolt 34 is configured to pass through the washer 37.

The illustrative nut 38 is a wing nut that receives the threaded end of the bolt 34. In the illustrative embodiment, the wing nut 38 includes a biasing element (not shown) that is configured to lock the wing nut 38 in place. By way of example and not of limitation, the biasing element for the wing nut includes a nylon ring (not shown) disposed on a winged end of the wing nut and an outer surface of the nylon ring interfaces with the inner threaded surface of the wing nut. Further detail of wing nut 38 is provided in FIG. 6.

The contoured component 40 ergonomically interfaces with a palm of a hand. By way of example and not of limitation, the contoured component 40 is composed of molded or extruded elastic materials having foam-like and/or rubber-like properties.

The tubular crutch 10 also includes a ground engaging extension 50 with a spring loaded button 52 that is configured to be received by at least one of the second plurality of orifices 24 at the bottom of the tubular elongated member 20. At the tip of the ground engaging extension is a crutch tip 54. By way of example and not of limitation, the crutch tip 54 is composed of an elastic compound with a relatively high coefficient of friction that prevents club slippage, provides cushioning, and minimizes wear-and-tear on the crutch tip. In the illustrative embodiment, the handle 30 is composed of a steel material such as carbon steel and the tubular crutch body 10 and ground engaging extension 50 is composed of an aluminum material.

Alternatively, the handle, tubular crutch body and ground engaging extension may be composed of materials capable of supporting an individual user including, but not limited to, carbon fiber reinforced polymer, wood, metal alloys, steel alloys, aluminum alloys, titanium alloys, carbon or glass fiber reinforced composites, and thermoplastic materials.

Figure 2A:
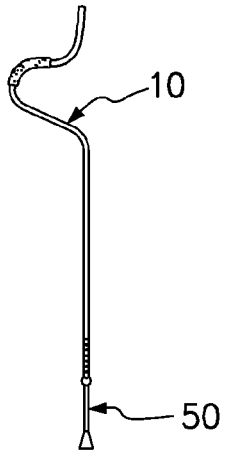
FIGS. 2A-2F show an instruction sheet for using the tubular crutch with the cantilever handle.
Figure 2B:
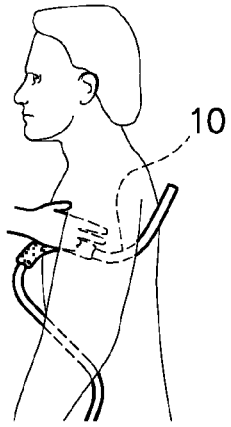
Figure 2C:
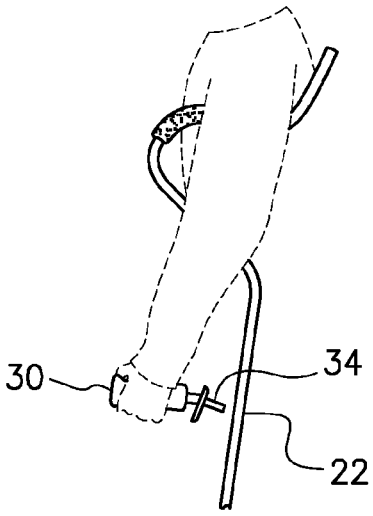
Figure 2D:
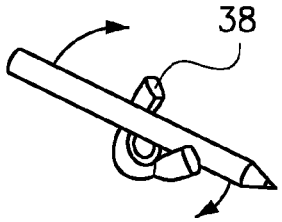
Figure 2E:
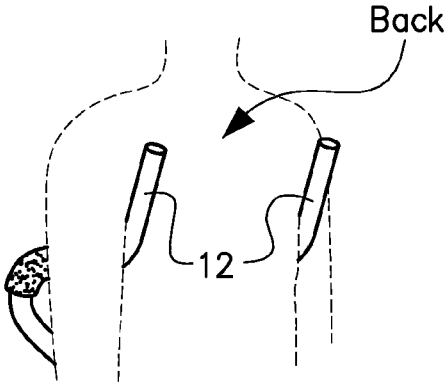

Referring now to FIGS. 2A-2F, there is shown an illustrative instruction sheet for using the tubular crutch with the cantilever handle. In FIG. 2A, the height of the ground engaging extension 50 is adjusted for the particular user. To determine the appropriate height, the crutch is placed under the user's arm and in a first plane that is parallel to the median plane. The crutch 10 is positioned so that two fingers fit below the underarm as shown in FIG. 2B. To fit the cantilever handle 30, the arm is kept straight and the bolt 34 is fit through the appropriate pair of orifices 22 as shown in FIG. 2C. In FIG. 2D, the wing nut 38 associated with the cantilever handle 30 is then tightened by hand or by using a lever that interfaces with the "wings" of the wing nut 38; by way of example and not of limitation, the lever may be a pen or pencil. The straight arms help keep the posterior stabilizing element 12 against the back of the shoulders as shown in FIG. 2E.

Figure 2F:
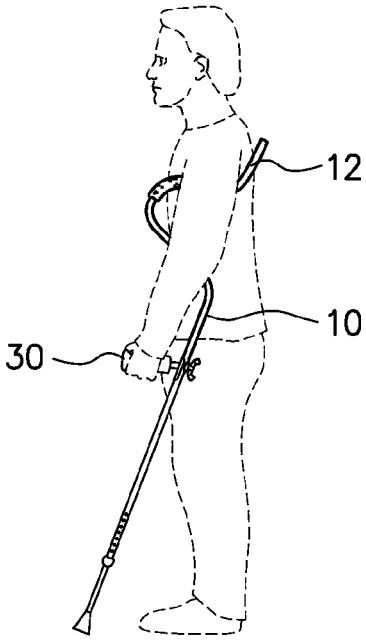

In FIG. 2F, a user is shown with the crutches in a rest or start position. There are two points of contact shown in this figure. The first point of contact is along the ergonomically designed cantilever handle 30. The second point of contact is between the posterior stabilizing element 12 and the back of the shoulders.

Figure 3:
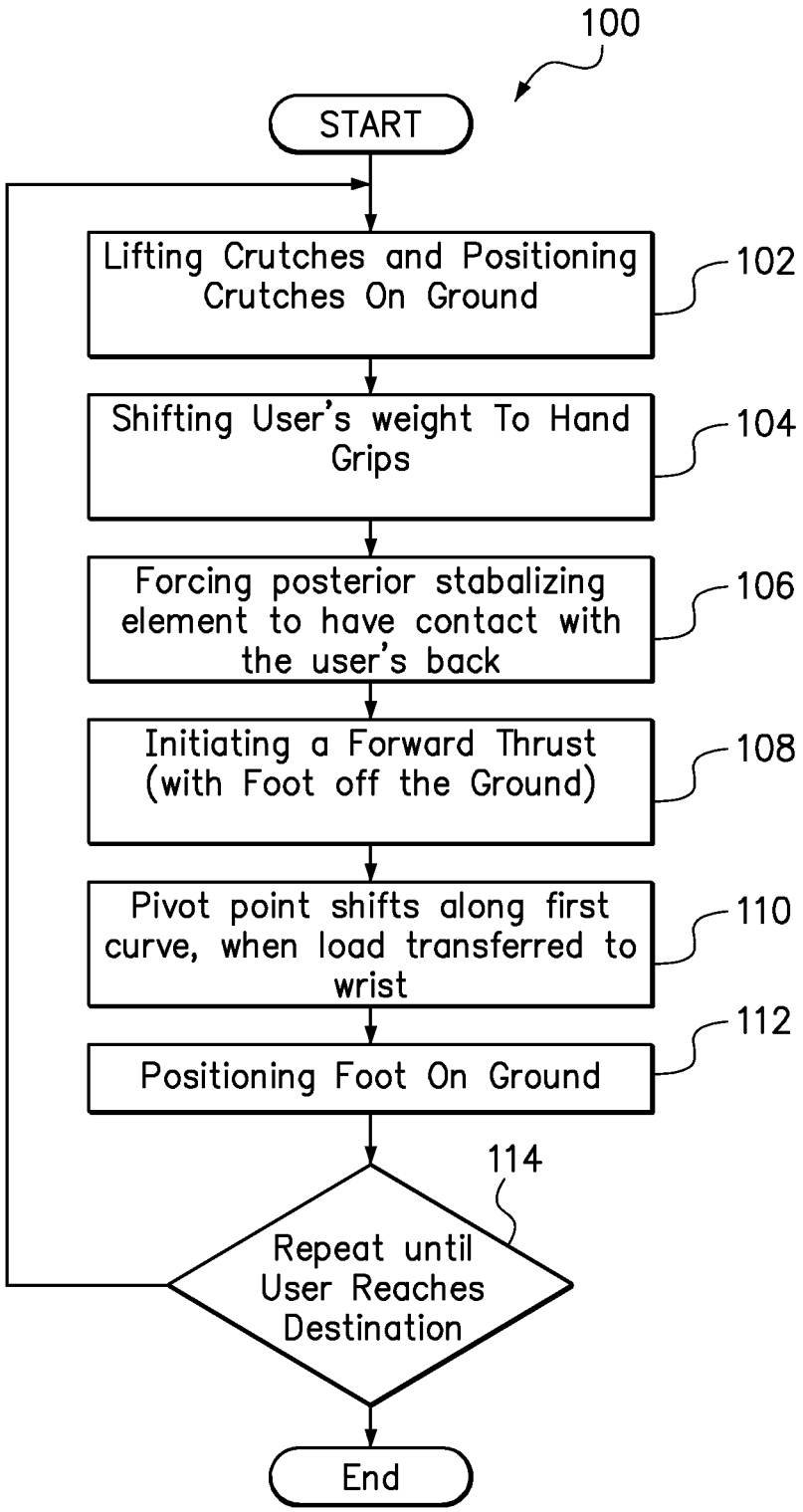
FIG. 3 shows a method for using the tubular crutch with a cantilever handle.

Referring now to FIG. 3, there is shown a method 100 for using the tubular crutch with a cantilever handle. The method 100 begins at block 102 where the user lifts the crutches and positions the crutches on the ground. At this instance, the user is standing in an upright position and distributing the user's weight substantially on one weight-bearing foot or both feet. As shown in FIG. 2F, the user is in a start position and grasping the cantilever handle 30. The tubular crutch body 10 is located between the user's arm and body.

In this start or rest position, the cantilever handle 30 is substantially horizontal, even though the cantilever is at a 10°-15° angle in relation to the tubular elongated portion 20 as described in further detail below. The user positions the crutch tip 54 in front of the user as shown in FIG. 2F, and the user's hand is in-front of the user's body. Additionally, the crutch tip 54 is further in front of the user's hand. Thus, when the crutch is in a resting position, the crutch is at a substantially angular position.

At block 104, the user shifts their weight from their feet or foot to the hand grips. The design of the crutch results in the crutch forcing the posterior stabilizing element 12 to have contact with the back of the user's shoulder, as described in block 106.

At block 108, the user initiates a forward thrust by pushing off with the weight-bearing foot. As the user is swinging through from a first start position to a second start position, the back of the user's shoulders contacts the posterior stabilizing element 12. The contact point between the user's shoulder and the posterior stabilizing element 12 acts as a pivot point; and this pivot point shifts as the user swings from the first position to the second position as described in block 110.

The shifting of the pivot point along first curve 14 minimizes the user's discomfort and minimizes injuries from crutches slipping because the crutches can no longer slip forward or laterally. Furthermore, in a resting or start position the crutches are already in front of the user, so they are unlikely to slip in the start or resting position.

At block 112, the user's weight is now shifted back to the weight bearing foot. The process is repeated until the user reaches the desired destination as represented by decision diamond 114.

Figure 4:
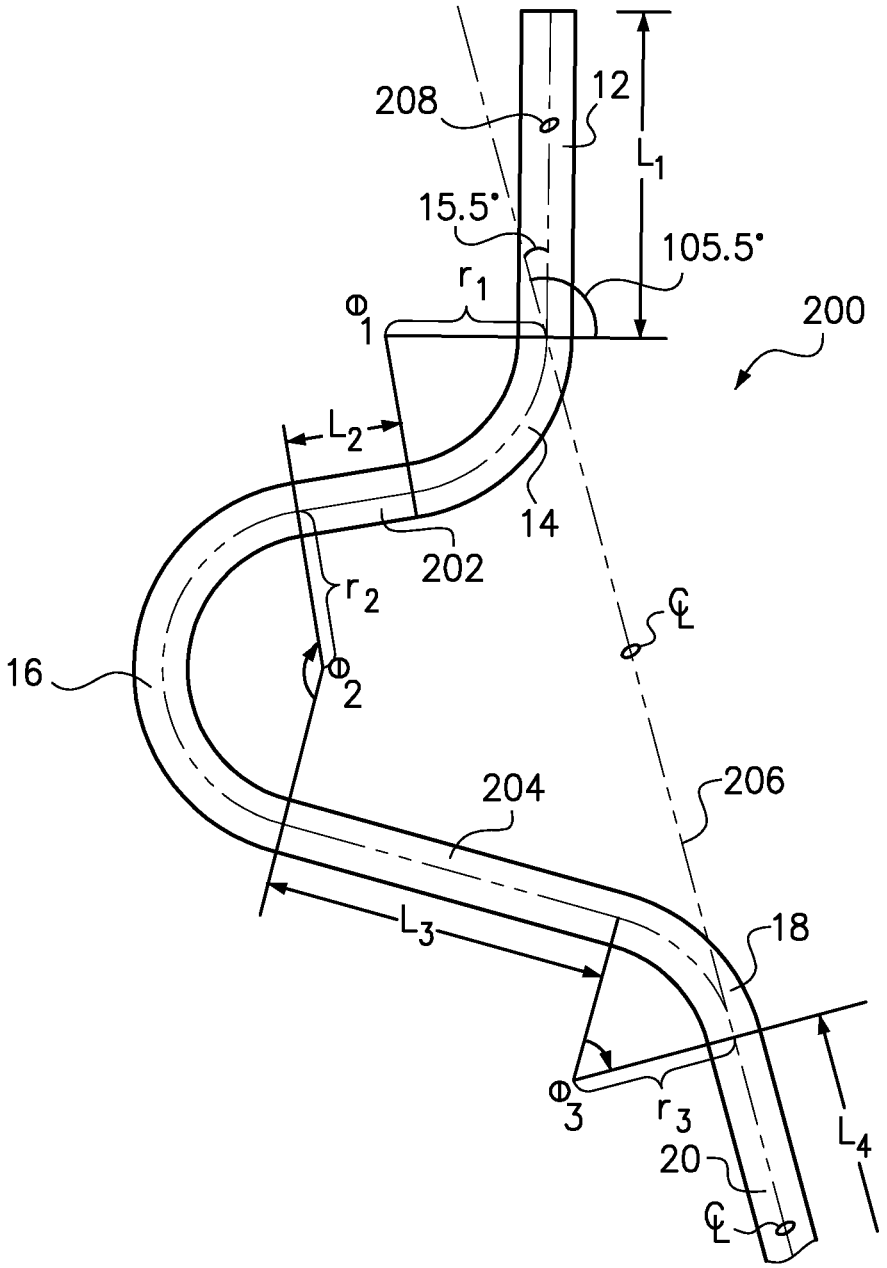
FIG. 4 shows a top portion of a tubular crutch body.

Referring to FIG. 4 there is shown a top portion 200 of the tubular crutch body 10. The posterior stabilizing element 12 has a first length that varies according to the size and weight of the individual and the material properties of the crutch body. By way of example and not of limitation, the posterior stabilizing element 12 has a length $L_1$ that varies in length from approximately 4 inches to 6 inches.

The first concave curve 14 adjacent to the posterior stabilizing element 12 includes a radius and a first angle, $\Theta_1$. In a broad embodiment, the first angle $\Theta_1$ ranges from 70°-90°. In a narrow embodiment, the illustrative first angle $\Theta_1$ is approximately 80°. Adjacent to the first angle is a first tubular portion 202 having a length of $L_2$. By way of example and not of limitation, the illustrative length for $L_2$ is approximately 2 inches.

The second convex curve 16 is adjacent to the first tubular portion 202 and is proximate to the first concave curve 14. In a broad embodiment, the second angle $\Theta_2$ ranges from 150°-165°. In a narrow embodiment, the illustrative second angle $\Theta_2$ is approximately 157°. Adjacent to the second angle is a second tubular portion 204 having a length of $L_3$. By way of example and not of limitation, the illustrative length for $L_3$ is approximately 6 inches.

The third concave curve 18 is adjacent to the second tubular portion 204 and is proximate to the second convex curve 16. In a broad embodiment, the third concave angle $\Theta_3$ ranges from 55°-70°. In a narrow embodiment, the illustrative third angle $\Theta_3$ is approximately 61.5°. Adjacent to the third angle is the tubular elongated portion 20 and the tubular portion 204 having a length of $L_4$. By way of example and not of limitation, the illustrative length for $L_4$ is approximately 29 inches.

The first concave curve 14, the second convex curve 16, the third concave curve 18 and tubular crutch body 10 are disposed along a first plane that is substantially parallel to the median plane of the user. The median plane bisects the body vertically and divides the body into the left and right side. When one of the crutches is in use, the first plane is approximately angled at 5°-10° degrees counterclockwise relative to the median plane of the user. More specifically, the first plane is approximately angled at 7° degrees counterclockwise relative to the median plane of the user.

In the illustrative embodiment shown in FIG. 4, the first radius, $r_1$, for the first concave curve 14, the second radius, $r_2$, for the second convex curve 16 and the third radius, $r_3$, for the third concave curve 18 are substantially similar. In a broad embodiment, the radius for each of the curves varies from 2 to 4 inches. In a narrow embodiment, the illustrative radius for $r_1$, $r_2$ and $r_3$ is approximately 3 inches.

In alternative embodiments, the radius may vary for each curve. Additionally, if the radius is different for one or more curves, the corresponding angle for each curve may also be affected. Thus, the angles and radius of the three curves may change. However, for the crutch to operate in the manner described above, a tubular elongated portion center line 206 intersects a tubular posterior stabilizing element center line 208 at 10°-20° counterclockwise relative to the tubular elongated portion center line 206. In a narrow embodiment, the tubular elongated portion center line 206 intersects a tubular posterior stabilizing element center line 208 at approximately 13°-17° counterclockwise relative to the tubular elongated portion center line 206. In an even narrower embodiment, the tubular elongated portion center line 206 intersects a tubular posterior stabilizing element center line 208 at approximately 15.5° counterclockwise relative to the tubular elongated portion center line 206.

Thus, even if the radius and angles change, as long the tubular elongated portion center line 206 intersects a tubular posterior stabilizing element center line 208 at the proper angle, the tubular crutch with the cantilever handle transfers the forward thrust from the hands directly to the back of the user's shoulder without the necessity of clamping the axillary element under the arm.

Figure 5A:
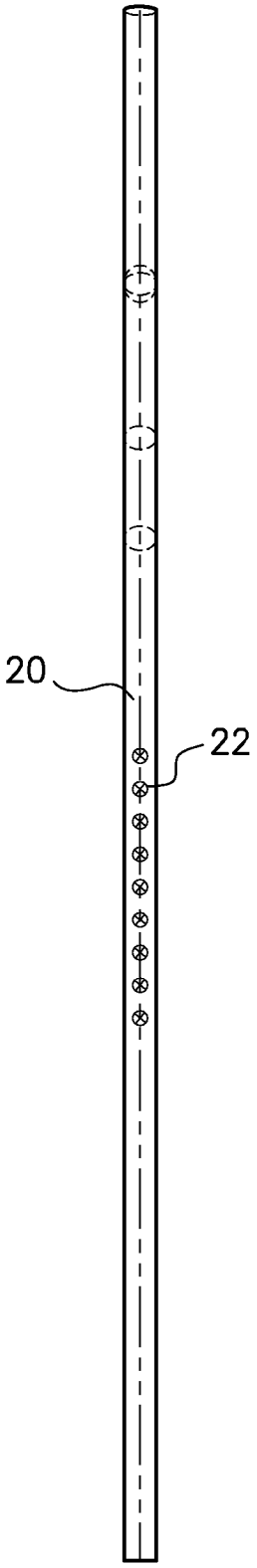
FIG. 5A shows a first side view of the tubular crutch body.

Referring now to FIG. 5A there is shown a first side view of the tubular crutch body in a second plane orthogonal to the first plane. The tubular elongated portion 20 includes the first grouping of orifices 22 or holes along the first plane. By way of example and not of limitation, there are nine 0.25 inch holes that are spaced one inch apart. The orifices or holes are punched through or bored on both sides of the tubular elongated portion 20. The grouping of orifices or holes is configured to receive the bolt 34 corresponding to the cantilever handle 30.

Figure 5B:
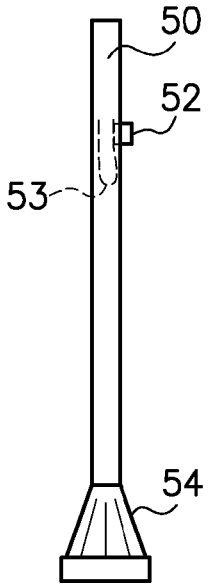
FIG. 5B shows a ground engaging extension that is received by the bottom of the tubular crutch body.

Referring now to FIG. 5B the ground engaging extension 50 includes a brass button 52 that is operatively coupled to spring 53. The spring loaded button 52 is a quick release button that is configured to be received by at least one of the second plurality of orifices 24 (shown in FIG. 5C) at the bottom of the tubular elongated member 20.

At the tip of the ground engaging extension 50 is a crutch tip 54. By way of example and not of limitation, the crutch tip 54 is composed of an elastic compound with a relatively high coefficient of friction that prevents club slippage, provides cushioning, and minimizes wear-and-tear on the crutch tip. In the illustrative embodiment, the tubular crutch body 10 and ground engaging extension 50 are both composed of an aluminum alloy.

Figure 5C:
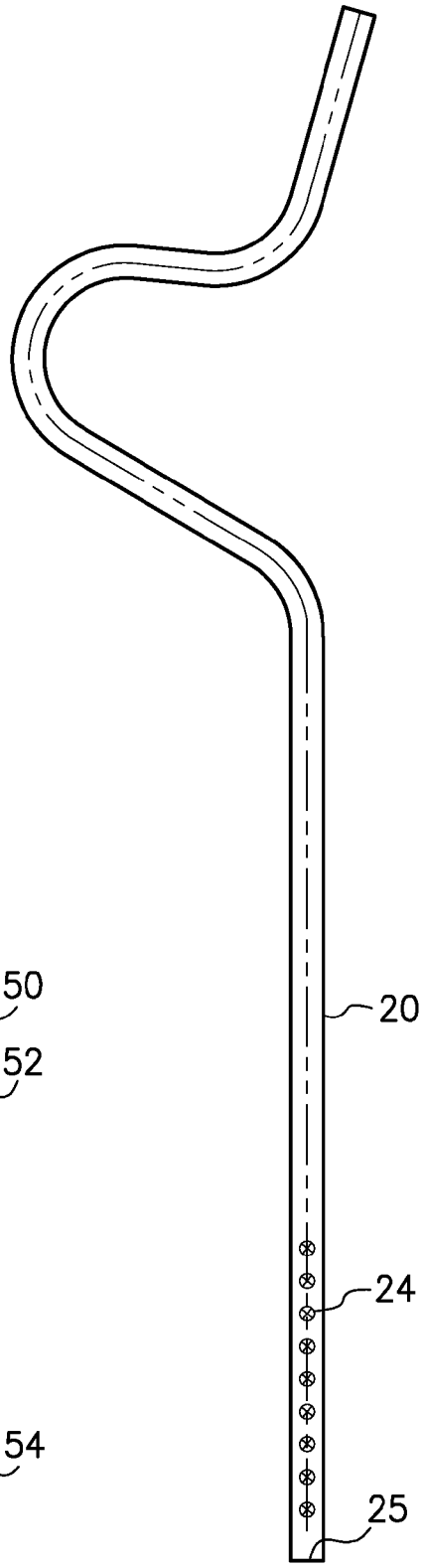
FIG. 5C shows a second side view of the tubular crutch disposed in a first plane.

Referring now to FIG. 5C there is shown a second side view of the tubular crutch disposed in a first plane. The tubular elongated portion 20 includes a second set of orifices 24 or bored holes at the bottom of the tubular elongated portion 20 for adjusting the height of the crutch assembly. The second set of orifices bored holes 24 are at a 90° degree angle from the first grouping of orifices 22. By way of example and not of limitation, there are nine holes that are punched through on one side only, the holes are 0.38 inches in diameter and are spaced one inch apart.

A base 25 is sized to telescopically receive the ground engaging extension 50. By way of example, the base 25 may include a plastic cap (not shown) with an opening that receives the ground engaging extension 50 that have relatively high tolerances. Additionally, the ground engaging extension 50 may also include a plastic cap that covers the tubular opening. The ground engaging extension 50 fits inside the tubular elongated portion 20 and is locked into place when the spring loaded button 52 passes through one of the second set of orifices 24.

Referring now to FIG. 6 there is shown the component pieces of the cantilever handle, excluding the contoured component 40 described above. The cantilever handle 30 includes a curved base plate 32, a bolt 34, and a tubular member 36 that are fixedly coupled to one another. The curved base plate 32 is configured to interface with the tubular elongated portion 20 and includes a base plate orifice 33 that receives the bolt 34. The bolt 34 has a threaded end and a head end, in which the head end is fixedly coupled to a convex side of the curved base plate 32 and the threaded end of the bolt is at a 90° angle from the curved base plate 32. In the illustrative embodiment, the bolt 34 is welded to the curved base plate 32 and the tubular member 36 is welded to the base plate 32.

The tubular member 36 has one end fixedly coupled to the convex side of the curved base plate 32 as shown in FIG. 6. The bolt 34 passes through one pair of the first orifices 22. In the illustrative embodiment, a contoured washer 37 is disposed on the opposite side of the tubular elongated portion 20 and the threaded bolt 34 is configured to pass through the washer 37.

The bolt 34 is received by a threaded nut of appropriate size and shape. By way of example and not of limitation, the nut is a threaded wing nut 38 that receives the threaded end of the bolt 34. In the illustrative embodiment, the wing nut 38 includes a biasing element 39 that is configured to lock the wing nut 38 in place. By way of example and not of limitation, the biasing element for the wing nut includes a nylon ring 39 disposed on a winged end of the wing nut and an outer surface of the nylon ring interfaces with the inner threaded surface of the wing nut.

In the broad embodiment, the tubular member 36 includes a tubular member center line 35 that extends into the first plane at an angle of approximately 75°-80° degrees counter-clockwise relative to curved base plate 32 that interfaces with the tubular elongated portion 20. In a narrow embodiment, the tubular member center line 35 extends into the first plane at approximately 78° degrees from the curved base plate 32 and the tubular elongated portion 20.

The description provided above describes the kit of parts for assembly to a crutch with a cantilever handle. As described above, the kit of parts includes a tubular crutch body, a ground engaging extension, a cantilever handle with the curved base plate and bolt, a nut, and a contoured component. Additionally, the illustrative embodiment includes a contoured washer configured to be disposed on the opposite side of the tubular elongated portion as described above.

It is to be understood that the foregoing is a detailed description of illustrative embodiments. The scope of the claims is not limited to these specific embodiments. Various elements, details, execution of any methods, and uses can differ from those just described, or be expanded on or implemented using technologies not yet commercially viable, and yet still be within the inventive concepts of the present disclosure. The scope of the invention is determined by the following claims and their legal equivalents.

What is claimed is:

1. A tubular crutch comprising:

a tubular crutch body that includes, a tubular posterior stabilizing element having a tubular posterior stabilizing element center line, a first concave curve adjacent to the posterior stabilizing element, wherein the first concave curve has a first angle of approximately 75°-85°;

a second convex curve proximate to the first concave curve, wherein the second convex curve has a second angle of approximately 152°-162°;

a third concave curve proximate to the second convex curve, wherein the third concave curve has a third angle of approximately 56.5°-66.5°, the first concave curve, the second convex curve, the third concave curve in a first plane, a tubular elongated portion adjacent to the third concave curve, the tubular elongated portion having a first plurality of paired orifices in the first plane and a second plurality of orifices at a second plane at a bottom of the tubular elongated portion;

the tubular elongated portion having a tubular elongated portion center line that is 10°-20° from the tubular posterior stabilizing element center line; and a cantilever handle that includes, a curved base plate configured to interface with the tubular elongated portion, the curved base plate having a base plate orifice, a bolt having a threaded end and a head end, wherein the head end is fixedly coupled to the curved base plate and the threaded end of the bolt extends through the base plate orifice and extends at a 90° angle from the curved base plate, a tubular member having one end fixedly coupled to a convex side of the curved base plate, the tubular member configured to extend into the first plane at approximately 75°-80° degrees from the curved base plate, the bolt configured to pass through one of the first plurality of paired orifices, a nut configured to receive the threaded end of the bolt, and a contoured component configured to ergonomically interface with a palm of a hand; and a ground engaging extension that includes a spring loaded button that is configured to be received by at least one of the second plurality of orifices at the bottom of the tubular elongated member.

2. The tubular crutch of claim 1 wherein the cantilever handle further comprises a contoured washer configured to be disposed on the opposite side of the tubular elongated portion, wherein the threaded bolt is configured to pass through the washer.

3. The tubular crutch of claim 1 wherein the tubular crutch body includes the first concave curve having the first angle of approximately 80°, the second convex curve having the second angle of approximately 157°, the third concave curve having the third angle of approximately 61.5°, and the tubular elongated portion center line is 15.5° from the tubular posterior stabilizing element center line.

4. The tubular crutch of claim 1 wherein the cantilever handle includes the tubular member configured to extend into the first plane at approximately 78° degrees from the curved base plate.

5. The tubular crutch of claim 1 wherein the nut comprises a wing nut and a biasing element that is configured to lock the wing nut in place.

6. The tubular crutch of claim 1 wherein the bolt is welded to the base plate and the tubular member is welded to the base plate.

7. The tubular crutch of claim 1 wherein the handle includes a steel material and a tubular crutch body that includes an aluminum material.

8. A cantilever handle comprising:

a tubular crutch body;

a curved base plate configured to interface with a tubular elongated portion of the tubular crutch body, wherein the curved base plate includes a base plate orifice;

a bolt having a threaded end and a head end, wherein the head end is fixedly coupled to the curved base plate and the threaded end of the bolt extends through the base plate orifice and extends at a 90° angle from the base plate;

a tubular member having one end fixedly coupled to a convex side of the curved base plate, the tubular member configured to extend into a first plane at approximately 78° degrees from the curved base plate;

the bolt welded to the curved base plate and the tubular member welded to the curved base plate;

the bolt configured to pass through one of a first plurality of paired orifices at a tubular elongated portion of the tubular crutch body; and a nut having an inner threaded surface configured to receive the threaded end of the bolt for securing the handle to the tubular crutch body.

9. The cantilever handle of claim 8 wherein the tubular crutch body includes a plurality of paired orifices disposed along the length of the tubular crutch body so that the cantilever handle height is configured to be adjustable with respect to the tubular crutch body.

10. The cantilever handle of claim 9, further comprising a contoured washer configured to be disposed on the opposite side of the tubular elongated portion, wherein the threaded bolt is configured to pass through the washer, and a contoured component configured to ergonomically interface with a palm of a hand.

11. The cantilever handle of claim 10, wherein the nut comprises a wing nut and a biasing element having a nylon ring disposed on a winged end of the wing nut and an outer surface of the nylon ring interfaces with the inner threaded surface of the wing nut.

12. The cantilever handle of claim 8 wherein the handle includes a steel material and tubular crutch body that includes an aluminum material.

13. A kit of parts for assembly to a crutch, the kit of parts comprising a tubular crutch body that includes, a tubular posterior stabilizing element having a tubular posterior stabilizing posterior stabilizing element center line, a first concave curve adjacent to the posterior stabilizing element, wherein the first concave curve has a first angle of approximately 75°-85°;

a second convex curve proximate to the first concave curve, wherein the second convex curve has a second angle of approximately 152°-162°;

a third concave curve proximate to the second convex curve, wherein the third concave curve has a third angle of approximately 56.5°-66.5°, the first concave curve, the second convex curve, the third concave curve in a first plane, a tubular elongated portion adjacent to the third concave curve, the tubular elongated portion having a first plurality of paired orifices in the first plane and a second plurality of orifices at a second plane at a bottom of the tubular elongated portion;

the tubular elongated portion having a tubular elongated portion center line that is 10°-20° from the tubular posterior stabilizing element center line; and a ground engaging extension that includes a spring loaded button that is configured to be received by at least one of the second plurality of orifices at a bottom of the tubular elongated member;

a cantilever handle configured to interface with tubular crutch body, the cantilever handle including, a curved base plate configured to interface with the tubular elongated portion, the curved base plate having a base plate orifice, a bolt having a threaded end and a head end, wherein the head end is fixedly coupled to the curved base plate and the threaded end of the bolt extends through the base plate orifice and extends at a 90° angle from the curved base plate, wherein the threaded end is configured to interface with the first plurality of paired orifices, a tubular member having one end fixedly coupled to a convex side of the curved base plate, the tubular member configured to extend into the first plane at approximately 75°-80° degrees from the curved base plate, a nut configured to receive the threaded end of the bolt; and a contoured component configured to ergonomically interface with the cantilever handle.

14. The kit of parts of claim 13 wherein, the tubular crutch body includes the first concave curve having the first angle of approximately 80°, the second convex curve having the second angle of approximately 157°, the third concave curve having the third angle of approximately 61.5°, the tubular elongated portion center line is 15.5° from the tubular posterior stabilizing element center line, and the cantilever handle includes the tubular member configured to extend into the first plane at approximately 78° degrees from the curved base plate.

15. The kit of parts of claim 13 wherein the nut comprises a wing nut and a biasing element configured to lock the wing nut in place.

16. The kit of parts of claim 15 wherein the biasing element for the wing nut comprises a nylon ring disposed on a winged end of the wing nut and an outer surface of the nylon ring interfaces with the inner threaded surface of the wing nut.

17. The kit of parts of claim 13 wherein the bolt is welded to the curved base plate and the tubular member is welded to the curved base plate.

18. The kit of parts of claim 13 wherein the handle includes a steel material and tubular crutch body that includes an aluminum material.

19. The kit of parts of claim 13 further comprising a contoured washer configured to be disposed on the opposite side of the tubular elongated portion, wherein the threaded bolt is configured to pass through the washer.

* * * * *